United States Patent [19]

Ohsako et al.

[11] 4,041,280

[45] Aug. 9, 1977

[54] MONEY COUNTING MACHINE

[75] Inventors: Kyoichi Ohsako, Kita; Katusuke Yamashita, Matsudo, both of Japan

[73] Assignee: Laurel Bank Machine Co., Ltd., Tokyo, Japan

[21] Appl. No.: 658,086

[22] Filed: Feb. 13, 1976

[30] Foreign Application Priority Data

Feb. 17, 1975 Japan ..... 50-19592

[51] Int. Cl.[2] ..... G06M 3/02; G07D 9/00

[52] U.S. Cl. ..... 235/92 CN; 235/92 PE; 235/92 R; 133/8 R

[58] Field of Search ..... 235/92 CN, 92 SB, 92 PE; 133/8 R; 194/DIG. 1, 1 G

[56] References Cited

U.S. PATENT DOCUMENTS 3,699,981 10/1972 Conant et al. ..... 235/92 CN

*Primary Examiner*—Joseph M. Thesz

*Attorney, Agent, or Firm*—Cameron, Kerkam, Sutton, Stowell & Stowell

[57] ABSTRACT

Money counting machine comprising a switch which produces signal pulses corresponding to the counted number of coins, a plural-digit counter which receives said signal pulses from the switch and produces bit signals corresponding to digits representing the counted coins together with sequentially produced clock pulses corresponding to particular digits, NAND gates connected with the counter allow an output to pass therethrough and through a selector switch when the selected number of coins are counted, said output being used to effect state change of a flip-flop circuit for terminating the money counting operation.

4 Claims, 5 Drawing Figures

32
NA1
NA2
NA3
NA4
NA5
NA6
NA7
NA8
33
50
100
500
1000
2000
3000
4000
5000
SW
S R
FLIP FLOP
Q
34
AMPLIFIER
35
26
SOLENOID
36
DETECTOR
IN T1T2T3T4
COUNTER
RE A B C D
31
INPUT DEVICE
30

MONEY COUNTING MACHINE

The present invention relates to money counting machines and more particularly to money counting machines provided with means for interrupting the money counting operation when a predetermined number of coins have been counted.

Conventionally, money counting machines have been equipped with means for interrupting the money counting operation when a desired or predetermined number of coins have been counted. Such interrupting means comprises a counting device which includes counting circuit means adapted to produce a stop signal for stopping money counting when the desired or predetermined number of coins have been counted. In known type of such counting device, the counting circuit means includes a plurality of digit counting circuits, one for each digit of the number to be counted, and generally requires separate and complicated wiring for each counting circuit.

Recent developments in the field of semiconductor technology has made it possible to provide a single counter which has a function equivalent to a plurality of digit counters. More specifically, there is a plural-digit counter which has a plurality of digit select terminals for sequentially providing clock pulses in regular time intervals and a plurality of bit signal terminals for providing signal pulses which are representative of coins being counted. The signal pulses from the bit terminals are synchronized with the clock pulses from the digit select terminals in such a manner that the bit signals represent a figure of the digit which corresponds to the digit select terminal from which the clock pulse is being presented. One example of such plural-digit counters is MSM 5502 4-DIGIT COUNTER available from Oki Electric Company in Tokyo, Japan. These plural-digit counters have been provided for use with display devices such as display tubes, and it has been considered as being difficult to apply this type of counters to money counting machines because the duration of output signal is very short so that the signal cannot provide an adequate electric energy to actuate solenoid means which has usually been employed in a mechanism for stopping the money counting.

The present invention has therefore an object to provide means for controlling the count of coins in money counting machines in a simple manner as compared with conventional machines.

Another object of the present invention is to provide money counting machines having plural-digit counters equipped in counting sections.

A further object of the present invention is to provide money counting machines in which money counting can be terminated without fail when a desired or predetermined number of moneys have been counted.

A still further object of the present invention is to provide money counting machines which have simple and compact wiring circuits as compared with those in conventional machines.

According to the present invention, the above and other objects can be accomplished by money counting machines of the coin type comprising detecting means for counting number of coins, means for providing coin count signals corresponding to the counted number of coins, a plural-digit counter including a plurality of digit select terminals from which clock pulses are sequentially delivered in regular time intervals and a plurality of bit signal terminals, said counter being connected with the detecting means to receive the coin count signals therefrom and produce bit signals in at least one of said bit signal terminals representing of the counted number of coins and corresponding to the digit which is represented by one of the clock pulses of the digit select terminals from which the clock pulse is being delivered, means connected with said digit selecting terminals and said bit signal terminals to receive signals therefrom for producing an output signal pulse when a predetermined number of coins have been counted, and memory circuit means for memorizing the output signal pulse to produce a stop signal for terminating counting operation of said counting means said memory circuit means being connected to receive said output signal pulse when a predetermined value of coins have been counted. In a preferred mode of the present invention, the memory circuit means is a bi-stable switching circuit which is adapted to be switched from one state to the other by means of the output signal pulse. It should of course be noted that other types of memory circuits, such as a multi-vibration, may also be used for the purpose.

The above and other objects and features of the present invention will become apparent from the following descriptions of a preferred embodiment taking reference to the accompanying drawings, in which.

Figure 1:
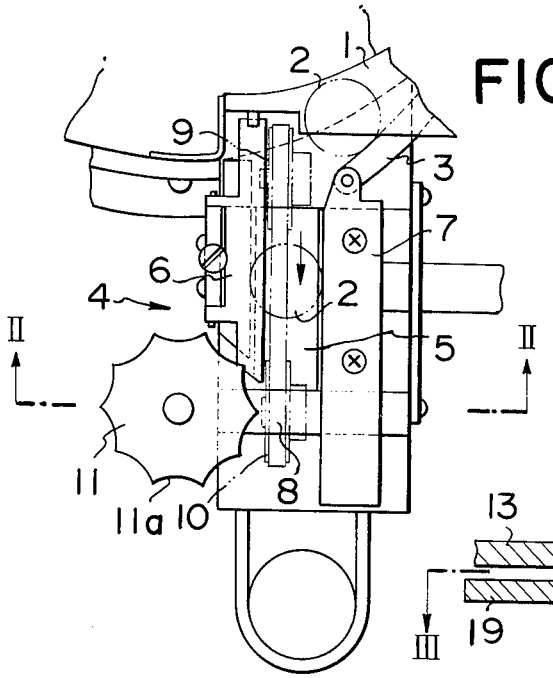
FIG. 1 is a fragmentary top plan view of a coin counting machine to which the present invention may be embodied.
Figure 2:
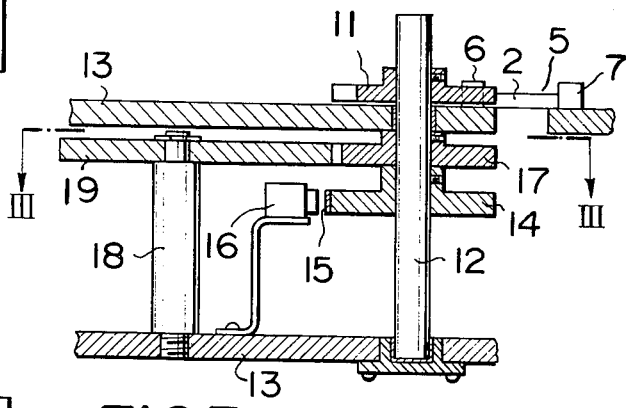
FIG. 2 is a sectional view taken substantially along the line II—II in FIG. 1.
Figure 3:
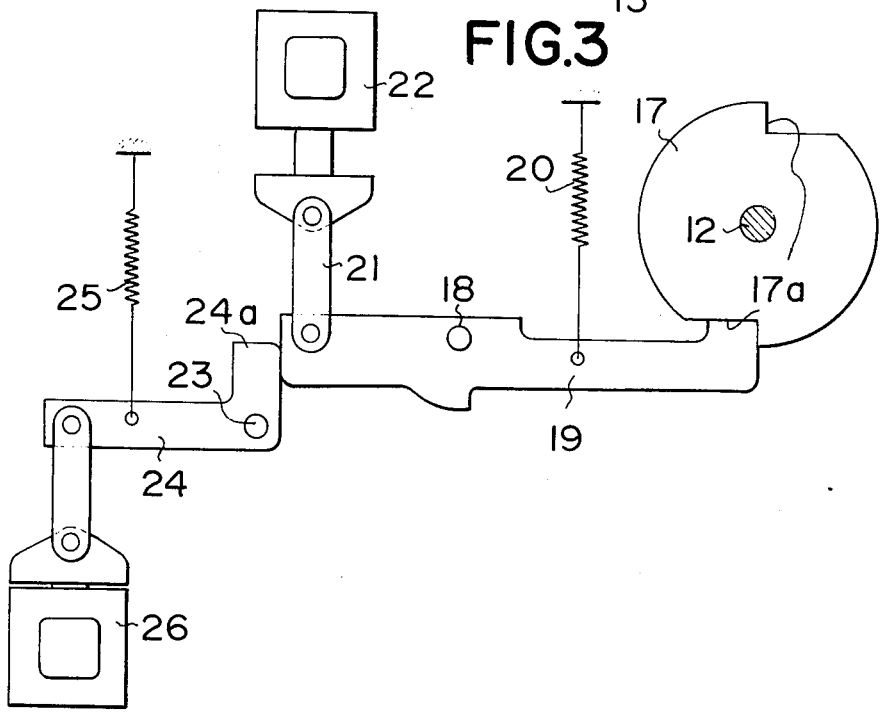
FIG. 3 is a sectional view taken substantially along the line III—III in FIG. 2.

Referring now to the drawings, particularly to FIGS. 1 through 3, there is fragmentarily shown a money counting machine which includes a rotating disc 1 by which coins 2 are driven along an arcuated guide plate 3 to a counting station generally shown by the reference numeral 4. The counting station 4 comprises a coin passage 5 which is defined by a pair of parallel guide members 6 and 7. Along the coin passage 5, there is disposed an endless driving belt 8 passing about a pair of spaced pulleys 9 and 10 and having a lower run adapted to engage the coin 2 in the passage 5 to drive it in the direction shown by an arrow in FIG. 1. At one side of the coin passage 5, there is provided a counting wheel 11 which has a plurality of arcuated recesses 11*a* provided on the periphery thereof for accommodating peripheral portion of the coin 2 passing through the passage 5. The counting wheel 11 is thus rotated by a predetermined angle each time one coin passes through the location of the wheel 11.

The counting wheel 11 is secured to a vertical shaft 12 which is rotatably supported on a base 13. The shaft 12 has a detecting wheel 14 having a suitable number of pieces 15 of magnetic material and a proximity switch 16 is supported on the base 13 in such a position that it is actuated each time when the piece 15 of magnetic material passes by the switch 16.

The vertical shaft 12 further has a locking disc 17 secured thereto. The disc 17 is formed at its periphery with cutouts 17*a* for the purpose described. below.

A second vertical shaft 18 is provided on the frame 13 and carries a stop lever 19 in such a manner that it is swingable in a horizontal plane. The lever 19 has one end adapted to be brought into engagement with one of the cutout 17*a* in the disc 17 to inhibit rotation thereof. A spring 20 is provided to act on the lever 19 to bias it into engagement with the cutout 17*a* in the disc 17. The other end of the lever 19 is connected through a link 21 with a starting solenoid 22 which may be energized through a starting switch (not shown). Thus, when the solenoid 22 is energized, said other end of the lever 19 is pulled to rotate the lever 19 clockwise as seen in FIG. 3 so that the lever 19 is disengaged from the cutout 17*a.*

A third vertical lever 23 is provided on the base 13 and carries an L-shaped holding lever 24 which is rotatable in a horizontal plane. A tension spring 25 is provided to bias the lever 24 in clockwise direction as seen in FIG. 3 and a stopping solenoid 26 is provided to pull the lever 24 in the opposite direction. The lever 24 has an end 24*a* which is normally in abutting engagement with the adjacent end of the lever 19 under the influence of the spring 25. When the stop lever 19 is rotated clockwise through energization of the solenoid 22, the lever 19 is disengaged from the cutout 17*a* in the disc 17 as described before. At the same time, the lever 24 is allowed to rotate further in the clockwise direction under the influence of the spring 25 so that the end 24*a* of the lever 24 is disposed beneath the adjacent end of the stop lever 19, whereby the stop lever 19 is prevented from returning to the engaging position even after the solenoid 22 is de-energized.

When the stop solenoid 26 is energized, the lever 24 is rotated counterclockwise against the influence of the spring 25 so that the end 24*a* of the lever 24 is moved out of engagement with the lever 19. Thus, the lever 19 is allowed to rotate counterclockwise under the influence of the spring 20 into engagement with the cutout 17*a* of the disc 17. In this manner, the disc 17 and therefore the counting wheel 11 are prevented from rotation so that the coin counting is terminated.

Figure 4:
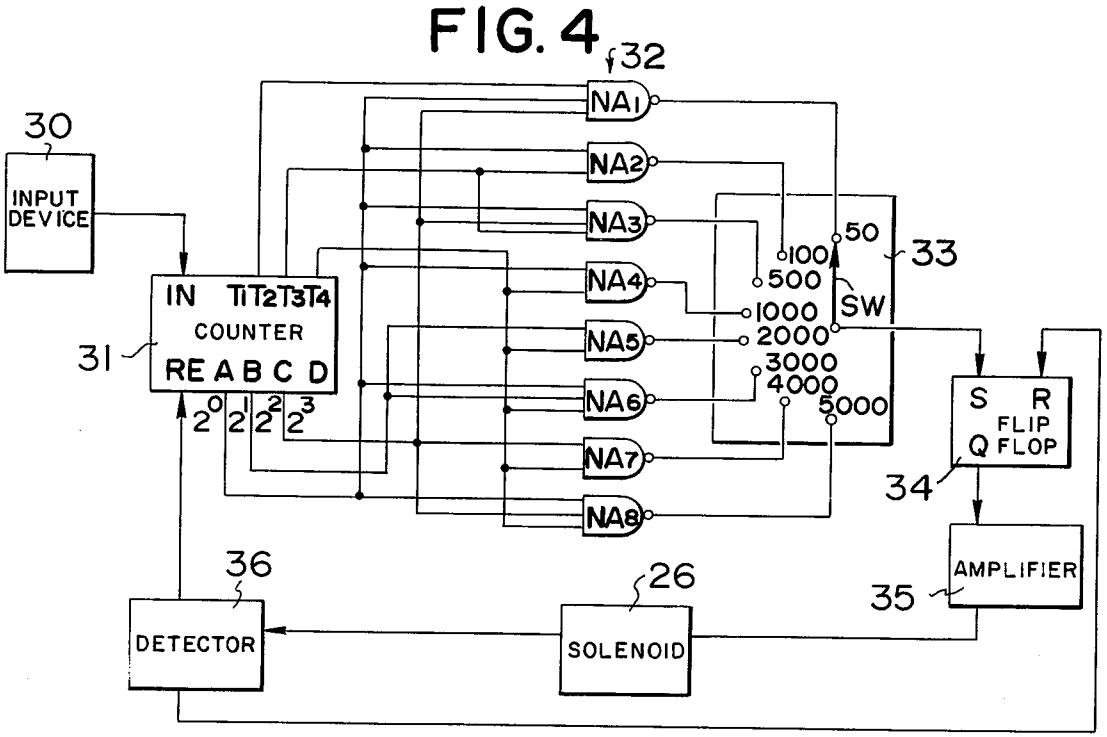
FIG. 4 is a circuit diagram of the counting device in accordance with one embodiment of the present invention; and, FIG. 5 is a diagram showing pulse and stop signals which will be produced in the circuit shown in FIG. 4.

Referring now to FIG. 4, there is shown an electric system for controlling coin counting. The system comprises an input device 30 which includes the aforementioned proximity switch 16 and produces an output signal pulse each time one coin passes through the coin passage 5. The input device 30 is connected with a plural-digit counter 31 which is in this embodiment a 4-digit counter and has four digit select terminals $T_1$, $T_2$, $T_3$ and $T_4$ and four bit terminals A, B, C and D. The counter also has an input terminal 1N which is connected with the output terminal of the input device 30 to receive the output signal pulse therefrom and a reset terminal RE.

Figure 5:
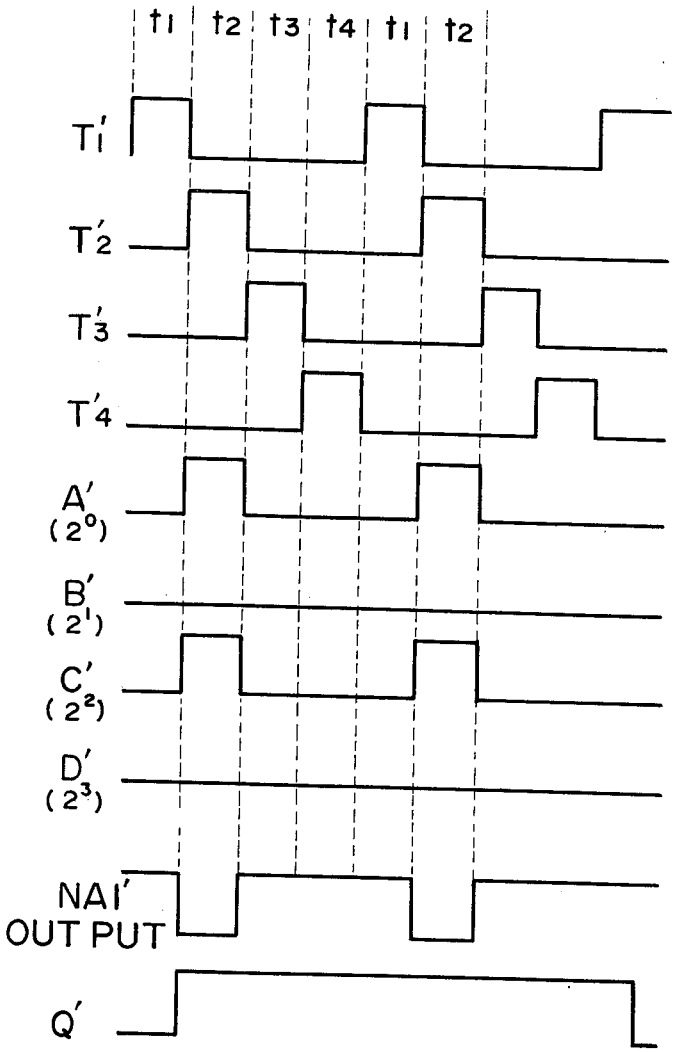

The 4-digit counter 31 produces digit signals or clock pulses sequentially at the terminals $T_1$ through $T_4$ as shown in FIG. 5. In time interval $t_1$, the clock pulse appears in the terminal $T_1$ and, in subsequent time interval $t_2$, the clock pulse appears in the terminal $T_2$. Similarly, the clock pulses appear in the terminals $T_3$ and $T_4$ in the subsequent time intervals $t_3$ and $t_4$. As long as the counter 31 is in operation, the clock pulses are presented repeatedly and sequentially in the terminals $T_1$, $T_2$, $T_3$ and $T_4$ in the manner described above.

The bit terminals A, B, C and D corresponds respectively the FIGS. $2^0$, that is 1, $2^1$, that is 2, $2^2$, that is 4 and $2^3$, that is 8. Signal pulses are produced at appropriate one or ones of the terminals A, B, C and D which correspond to a figure in the digit which is represented by the digit select terminal $T_1$, $T_2$, $T_3$ or $T_4$ in which the clock pulse is being presented. For example, when a number forty-five has been counted by the counter 31, signal pulses are produced at the terminals A and C to represent a figure five at the time interval in which a clock pulse is presented in the terminal $T_1$. In next time interval in which a clock pulse appears in the terminal $T_2$, a signal pulse is produced only in the terminal C to represent a figure four. This type of 4-digit counter is available from Oki Electric Company in Tokyo as type MSM 5502.

The system further includes a gate device 32 having a plurality of NAND gates $NA_1$, $NA_2$, $NA_3$, $NA_4$, $NA_5$, $NA_6$, $NA_7$ and $NA_8$ and a selector switch 3 which has contacts of such number that corresponds to the number of the NAND gates. The contacts of the selector switch 33 respectively represent fifty, one hundred, five hundred, one thousand, two thousands, three thousands, four thousands and five thousands of coins in this specific example.

The digit select terminal $T_2$ is connected with the NAND gate $NA_1$, the terminal $T_3$ with the gates $NA_2$ and $NA_3$ and the terminal $T_4$ with the gates $NA_4$, $NA_5$, $NA_6$, $NA_7$ and $NA_8$. The bit terminal A is connected with the NAND gates $NA_1$, $NA_2$, $NA_3$, $NA_4$, $NA_7$, $NA_6$, $NA_7$ and $NA_8$, the terminal B with the gates $NA_5$ and $NA_6$, and the terminal C with the gates $NA_1$, $NA_3$, $NA_7$ and $NA_8$. The contacts representing coin numbers of fifty, one hundred, five hundred, one thousand, two thousands, three thousands, four thousands and five thousands are respectively connected with the output terminals of the NAND gates $NA_1$, $NA_2$, $NA_3$, $NA_4$, $NA_5$, $NA_6$, $NA_7$ and $NA_8$.

There is also provided a memory circuit, that is, in this example, a flip-flop circuit 34 having an input terminal S, a reset terminal R and an output terminal Q. The input S of the circuit 34 is connected with the selector switch 33, and the output Q through an amplifier 35 with a solenoid 26 which has been described with reference to FIG. 3.

A solenoid actuation detector 36 is further provided in such a manner that it detects that the solenoid 26 has been energized and actuated, and then produces a signal which is transmitted to the reset terminal RE of the counter 31 and the reset terminal of the circuit 34.

When it is desired to have fifty coins delivered, the selector switch 33 is turned to close the corresponding contact, and the machine is started by closing the starting switch (not shown). Each time a coin passes through the passage 5, the proximity switch 16 produces a signal pulse which is transmitted from the input device 30 to the input terminal 1N of the counter 31.

As previously described and as shown in FIG. 5, a clock pulse is produced in the digit select terminal $T_2$ during time interval $t_1$ and sent to the NAND gate $NA_1$. Further, appropriate signal pulses appear in the bit terminals A, B, C and D in accordance with the counted number of coins at appropriate time intervals. When 50 coins are counted, signal pulses are sent from the terminals A and C to the gate $NA_1$ during the time interval $t_2$ in which clock pulse is also sent from the terminal $T_2$ to the gate $NA_1$. Thus, the gate $NA_1$ is closed and the input to the flip-flop circuit 34 is interrupted so that the circuit 34 is switched and an output is produced at the terminal Q as shown in FIG. 5. The output is then amplified by the amplifier 35 and transmitted to the solenoid 26. Then, the lever 24 shown in FIG. 3 is rotated counterclockwise against the force of the spring 25 to allow the lever 19 to turn under the influence of the spring 20 into the lock position to interrupt further delivery of coins. As soon as the actuation of the solenoid 26 is detected, reset signals are sent from the detector 36 to the counter 31 and the flip-flop circuit 34.

It should be noted that the system in accordance with the present invention is very simple in wirings as compared with conventional systems. Although the counter 31 produces signals only in the form of pulses, the memory circuit provides an output signal of sufficient duration to actuate the solenoid 26.

The invention has thus been shown and described with reference to a specific embodiment, however, it should be noted that the invention is in no way limited to the details of the illustrated arrangements but changes and modifications may be made without departing from the scope of the appended claims. For example, the present invention has been specifically described with reference to a coin counting machine, however, it can similarly be applied to bill counting machines. Further, the flip-flop circuit may be substituted by other types of memory circuit such as a multivibration.

We claim:

1. A coin mounting machine comprising detecting means for counting coins and for providing coin count signals corresponding to counted number of coins, a plural-digit counter including a plurality of digit select terminals from which clock pulses are sequentially delivered in regular time intervals and a plurality of bit signal terminals, said counter being connected with the detecting means to receive the coin count signals therefrom and produce bit signals in at least one of said bit signal terminals representative of counted number of coins and corresponding to the digit which is represented by one of the clock pulses of the digit select terminals from which the clock pulse is being delivered, means connected with said digit selecting terminals and said bit signal terminals to receive signals therefrom for producing an output signal pulse when a predetermined number of coins have been counted, and memory circuit means for memorizing the output signal pulse to produce a stop signal for terminating counting operation of said counting means, said memory circuit means being connected to receive said output signal pulse when a predetermined number of coins have been counted.

2. Money counting machine in accordance with claim 1 in which said memory circuit means is a bistable switching circuit which is adapted to be switched from one state to the other by means of the output signal pulse to produce said stop signal.

3. Money counting machine in accordance with claim 1 in which said output signal producing means includes NAND gate means having a plurality of NAND gates which are closed when predetermined bit signals are applied thereto simultaneously with the corresponding clock pulse from the corresponding digit select terminal, so as to supply the memory circuit means with said output signal pulse.

4. Money counting machine in accordance with claim 3 in which selector switch means is provided between the NAND gate means and the memory circuit means.

* * * * *